US006454291B1

(12) United States Patent
Hillairet et al.

(10) Patent No.: US 6,454,291 B1
(45) Date of Patent: Sep. 24, 2002

(54) SKI BINDING

(75) Inventors: Jean-Marc Hillairet, Nevers; Frédéric Farges, Grezolles; Christophe Vaglio, Le Creusot; Alexandre Bossus, Paris, all of (FR)

(73) Assignee: Look Fixations S.A., Nevers (FR)

( * ) Notice: Subject to any disclaimer, the term of this patent is extended or adjusted under 35 U.S.C. 154(b) by 0 days.

(21) Appl. No.: 09/451,824

(22) Filed: Nov. 30, 1999

(30) Foreign Application Priority Data

Dec. 8, 1998 (FR) ..... 98 15623

(51) Int. Cl.[7] ..... A63C 9/08
(52) U.S. Cl. ..... 280/623; 280/616; 280/617
(58) Field of Search ..... 280/607, 616, 280/617, 618, 623, 626, 628, 629, 630, 633, 634

(56) References Cited

U.S. PATENT DOCUMENTS 3,830,510 A * 8/1974 Stauffer ..... 280/633 X
4,522,422 A * 6/1985 Jaeger ..... 280/633 X
4,592,568 A 6/1986 Priskich Damir
4,657,277 A * 4/1987 Haldemann et al. ..... 280/616
4,889,359 A 12/1989 Kowatsch et al.
5,129,668 A * 7/1992 Hecht ..... 280/607
5,150,914 A * 9/1992 Gorza ..... 280/616
5,558,353 A 9/1996 Arduin et al.
5,735,541 A 4/1998 Fritschi et al.
5,899,484 A 5/1999 Paradis

* cited by examiner

*Primary Examiner*—Daniel G. DePumpo
*Assistant Examiner*—Paul Royal, Jr.
(74) *Attorney, Agent, or Firm*—Bugnion S.A.; John Moetteli

(57) ABSTRACT

A ski binding includes a stop (3) and a heel piece (5). An elastic means opposes the release of the stop and the heel piece. The elastic means includes a blade (6) working in buckling mode between two slides (2, 4) which correspond to the stop and the heel piece, respectively. Conventional springs for releasing the stop and the heel piece are therefore replaced by this longitudinally arranged blade.

9 Claims, 5 Drawing Sheets

SKI BINDING

BACKGROUND OF THE INVENTION

The present invention relates to a ski binding intended for disengageably attaching a boot to a ski, comprising a front binding, known as a stop, and a rear binding, known as a heel piece, this stop and this heel piece being held elastically in a determined position corresponding to the position of the boot attached to the ski, and in which position the front stop is held elastically by a spring arranged at least approximately longitudinally in the direction of the heel piece.

A binding of this kind is known from U.S. Pat. No. 5,735,541, the content of which is incorporated by reference. The longitudinally-mounted spring is a helical spring which opposes the pivoting of the jaw of the stop. The heel piece comprises an attachment body in which is mounted approximately vertically a spring which opposes the pivoting of a heel-gripping jaw which acts on the spring via a piston. The stop and the heel piece are connected by a bar which acts as a support for the heel piece, but they could be mounted on the ski independently of one another. Therefore, as far as the stop is concerned, this binding differs from previous ski bindings in which the release spring is mounted in the body of the stop. Moreover, this binding comprises, like the earlier bindings, a helical spring made of steel for each of the binding elements, front and rear. What is more, in the heel piece, the spring still occupies a significant volume of the body of the heel piece.

In document U.S. Pat. No. 5,899,484, the content of which is incorporated by reference, it has, incidentally, been proposed that, in one stop, the helical spring should be replaced by a blade working in buckling mode. A solution of this kind has the advantage that in buckling, the resistance offered by the blade drops sharply, allowing the boot to escape more easily, the buckled blade behaving like a spring of relatively low stiffness but with a high preload.

SUMMARY OF THE INVENTION

The present invention aims to produce a ski binding with a simpler stop, and heel piece, a small volume and allowing greater use of elements made of non-metallic composite.

To this end, the ski binding according to the invention is one wherein said spring, arranged at least approximately longitudinally, consists of at least one blade operating in buckling mode and also elastically retaining the stop.

This blade is arranged flat under the boot, in a space which becomes available by the raising of the boot, which is characteristic of the current tendency in favor of edge gripping. It is preferably made of a composite material such as fiber-reinforced plastic, the fibers being made of glass or of carbon or of KEVLAR (trade mark), but it could just as easily be made of metal.

The stop and the heel piece no longer have a spring. Forces can be applied from the jaws of the stop and of the heel piece to said blade simply using levers or cams.

The simplest construction consists in making the blade work in buckling mode between two parts that can move in longitudinal translation and are kinematically connected to the stop and to the heel piece, respectively.

The kinematic connections may be achieved using levers.

According to one embodiment of the invention, the stop and the heel piece are mounted on a longitudinal support in the form of a slide, in which there are mounted two sliders associated respectively with the stop and with the heel piece so as to be carried along toward one another when the stop or the heel piece is displaced relative to its position of rest, said blade being mounted between these two sliders.

With the exception of the levers which provide the kinematic connection between, on the one hand, the stop and the heel piece and, on the other hand, the sliders, the stop and the heel piece may be made in the known way and it is even possible to re-use the existing stop and heel piece elements in their current form. As far as the heel piece is concerned, the piston found in many heel pieces is advantageously kept as an intermediate element between the jaw and the lever, for applying the force of the jaw to the lever, this piston advantageously being guided in a direction that encourages forces to be transmitted from the jaw to its slider.

The setting of the binding may be adjusted simply by using a part surrounding the blade and mounted like a nut on a longitudinal adjusting screw mounted and retained axially in one of the sliders.

It should be remembered that in order to adjust the length of the binding, that is to say to alter it to suit the size of the boot, it is necessary for it to be possible to move the heel piece relative to its slider, and this means that it must be possible for the point connecting the heel piece to its slider to move. To adjust the length, the heel piece will generally be in such a position that the blade has moved beyond its buckling point and it is necessary to keep the blade in that condition during adjustment. This can be done simply using an auxiliary screw stop screwed longitudinally into said longitudinal support.

BRIEF DESCRIPTION OF THE DRAWINGS

The drawing depicts, by way of example, one embodiment of the binding according to the invention.

DETAILED DESCRIPTION OF THE PREFERRED EMBODIMENTS

Figure 1:
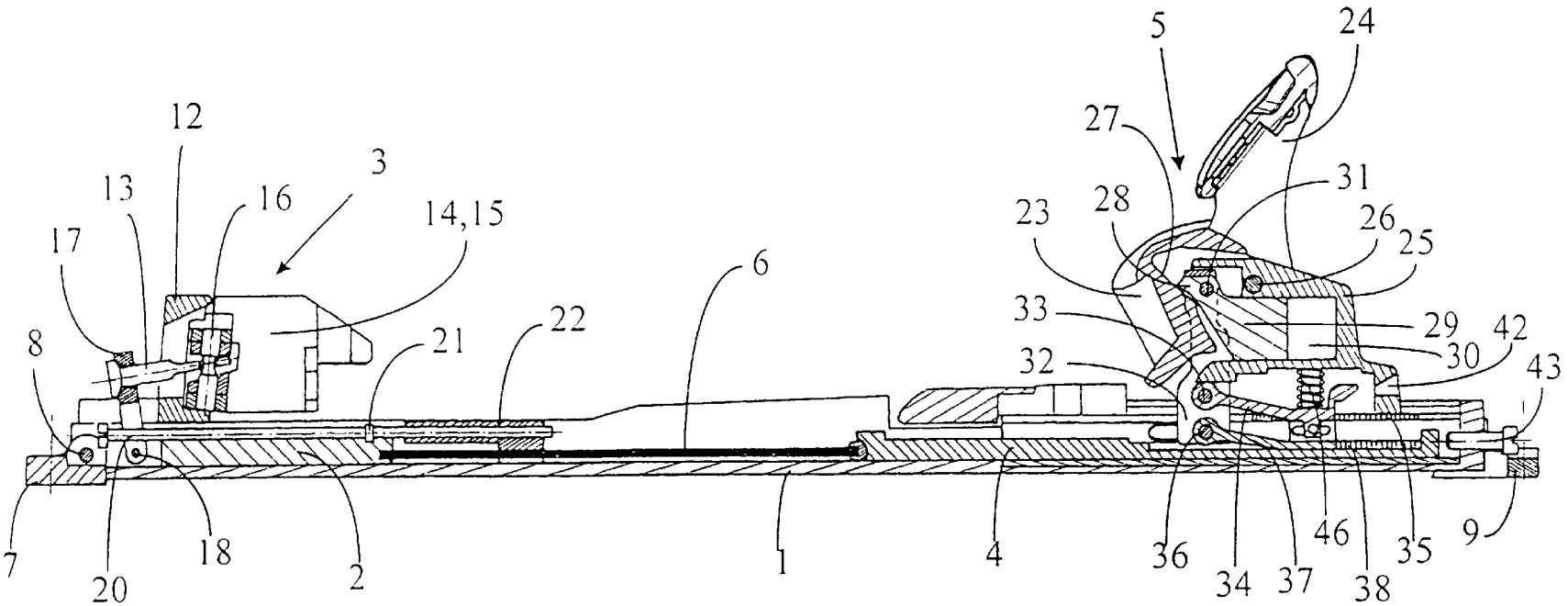
FIG. 1 is a view in vertical axial section of the binding, with the heel piece in the engaged position.
Figure 2:
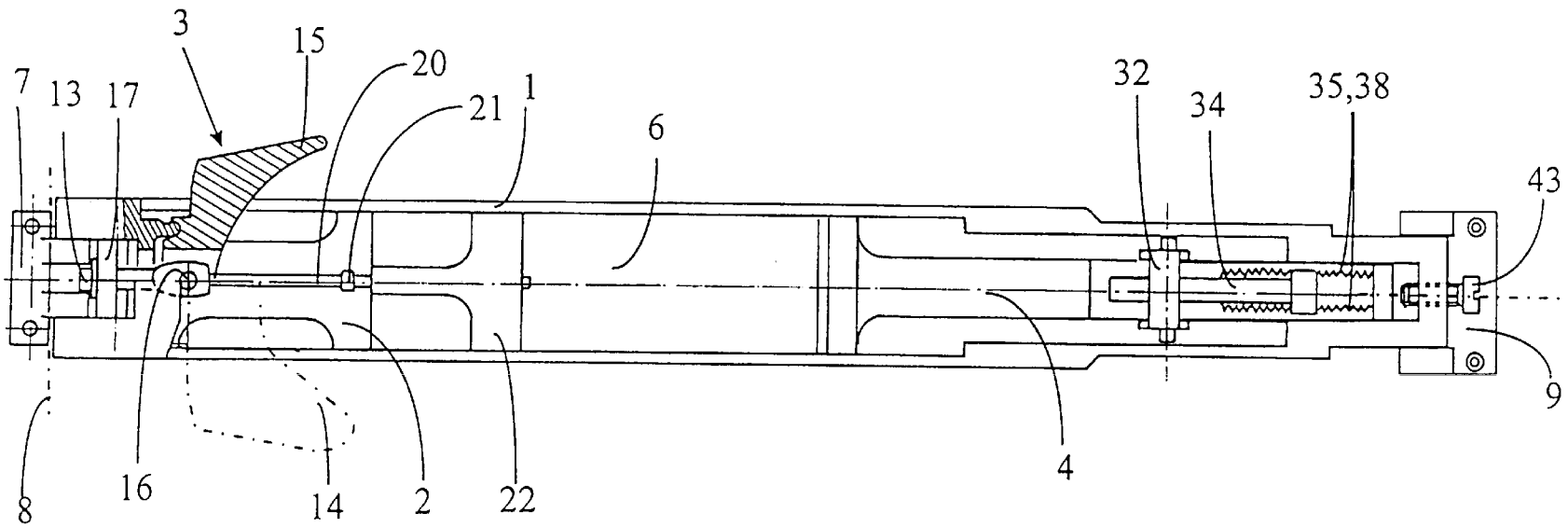
FIG. 2 is a plan view, from above, of the binding, without the heel piece body and the elements articulated to this body and, at the front, the arms of the front stop, one is which is depicted in section.

Reference is first of all made to FIGS. 1 and 2. The binding depicted essentially comprises a longitudinal support 1 in the form of a slide in which there is mounted a first slider 2 associated with a stop 3 constituting a front binding element, and a second slider 4 associated with a heel piece 5 constituting a rear binding element, and a blade 6 arranged horizontally in the support 1 between the sliders 2 and 4.

Figure 3:
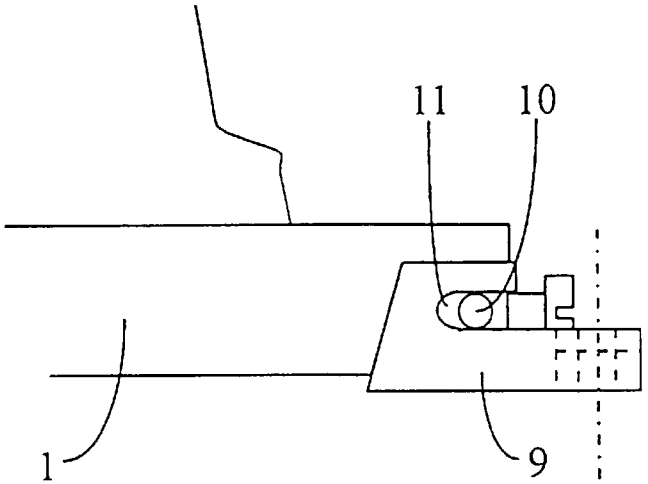
FIG. 3 is a side view showing details of the rear of the binding.

Further referring to FIG. 3, the longitudinal support 1 is attached to the ski at the front by means of an intermediate attachment piece 7 on which the support 1 is articulated about a transverse axle 8 and, at the rear, by means of an intermediate part 9 secured to the ski by screws like the part 7 and in which the support 1 is held vertically by a transverse axle 10 but can slide longitudinally in two opposed grooves or slots 11. This way of mounting the binding on the ski has the effect of making the ski unbound in the region of the binding. The ski can therefore flex freely in this region.

Figure 4:
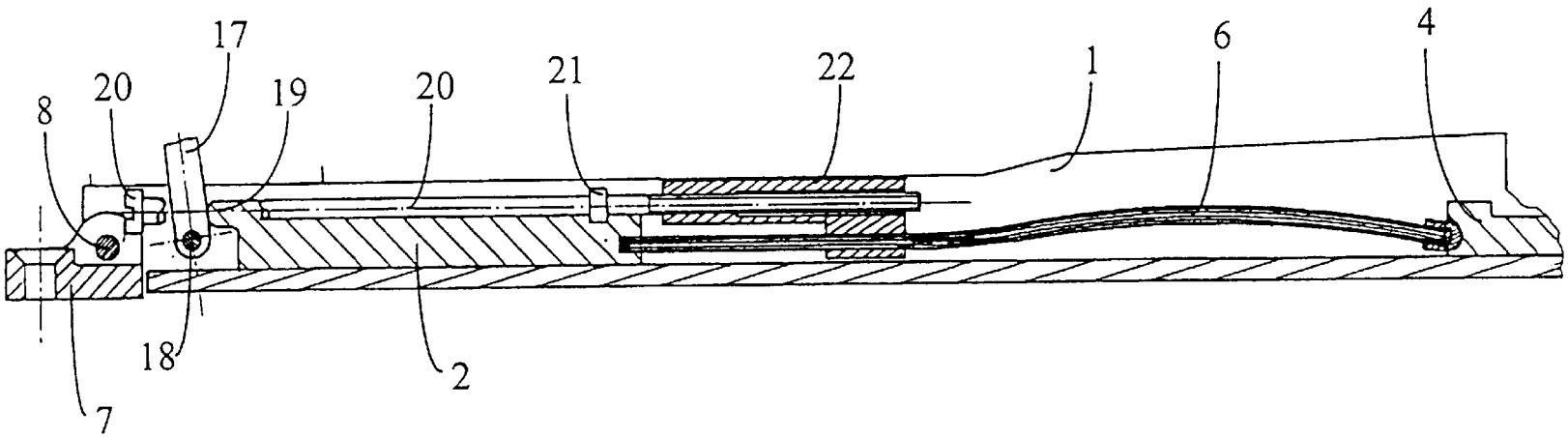
FIG. 4 is a detail view of the front part of the binding, with the blade compressed.

The stop 3 is a stop similar to the stop described in U.S. Pat. No. 4,889,359, the content of which is incorporated by reference. It does, however, differ from that stop in that it has a shortened stop body 12 which no longer contains either a spring or a tubular nut against which the spring rests. What it does retain, on the other hand, is the tie rod 13, one end of which is connected to the arms 14 and 15 of the stop via a vertical axle 16. The other end of the tie rod 13 is, in this instance, connected to a lever of the second kind 17, the lower end of which is articulated to the support 1 about a transverse axle 18. As depicted in FIG. 2 of U.S. Pat. No. 4,889,359, the arms 14 and 15 press on vertical ribs of the binding body 12, on which ribs they can rock, exerting tension on the tie bolt 13. The lever 17 presses at an intermediate point against a nose 19 of the slider 2 (FIG. 4) which, in FIG. 1, is hidden by an axial adjusting screw 20 used to adjust the release setting of the binding, as will be described later on. This screw 20 is borne by the slider 2 through which it passes through an unthreaded part. It is held axially in the slider 2 by a collar 21. Its threaded part is engaged in a part 22 through which the blade 6 passes freely. Using the screw 20, it is thus possible to move the part 22 along the blade 6.

Figure 5:
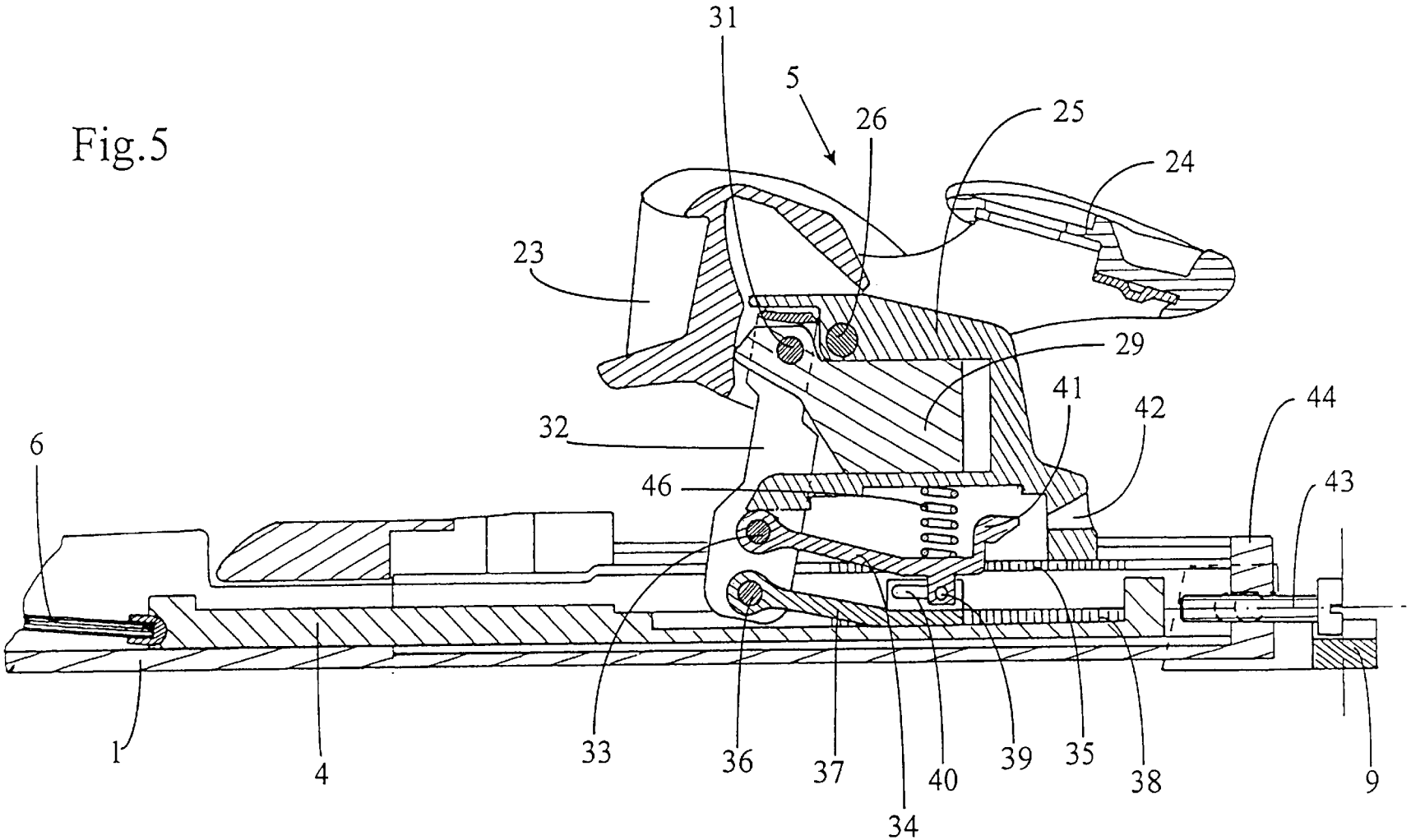
FIG. 5 is a sectioned view similar to FIG. 1, depicting the heel piece in the open position.

The heel piece 5 also re-uses the elements of a heel piece of the known type, except for its spring. One recognizable element is a jaw or sole-gripper 23, formed as one piece with a lever 24 for deliberately opening the binding and articulated to a binding body 25 about a transverse axle 26. Another recognizable element is the interior ramp 27 of the jaw 23, against which there bears the nose 28 of a piston 29 sliding in an axial cylindrical housing 30 in which there is no longer the spring customarily found in heel pieces of this type. Articulated to the nose 28 of the piston 29, about a transverse axle 31, is the upper end of a lever 32 made of a U-shaped part passing over the nose 28 and extending roughly vertically on each side of the piston 29. This lever 32 constitutes the retaining element of the sole-gripper jaw 23. It has a transverse intermediate axle 33 to which is articulated one end of a first arm 34, the other end of which is held in first serrations 35 consisting of two opposed sets of teeth, belonging to the support 1. As the arm 34 is rigid, the axle 33 constitutes a fixed articulation of the lever 32 relative to the support 1. The lower end of the lever 32 has a transverse axle 36 about which is articulated one end of a second arm 37, the other end of which is fixed in serrations 38, consisting of two opposed sets of teeth, belonging to the second slider 4. The rotation of the lever 32 about the axle 33 therefore has the effect of moving the slider 4 in the support 1. This movement is visible in FIG. 5 where the heel piece 5 is depicted in the open position. In this position, the jaw 23 has pushed back the piston 29 which has driven the lever 32 which has forced the slider 4 to move forward. The slider 2 is held by the lever 17, itself held by the tie rod 13 rigidly retained by the arms 14 and 15 of the front stop 3. The axial compression of the blade 6 is such that this blade buckles as can be seen in FIG. 5.

As can be seen in FIG. 2, the teeth of the serrations 35 and 38 are precisely superposed so that, when viewed from above, just one of these sets of serrations is visible. The opposite ends of the arms 34 and 37, from their joints to the lever 32, are connected by a transverse axle 39 integral with the arm 34 and passing through a horizontal longitudinal aperture 40 in the arm 37. Those parts of these arms which are adjacent to this articulation 39 have, on each side, teeth which correspond to the teeth of the sets of teeth 35 and 38 and which are engaged with these teeth. The end 41 of the upper arm 34 is elbowed twice and can be reached using a tool, for example a screwdriver, th rough a hole 42 in the binding body 25.

Figure 6:
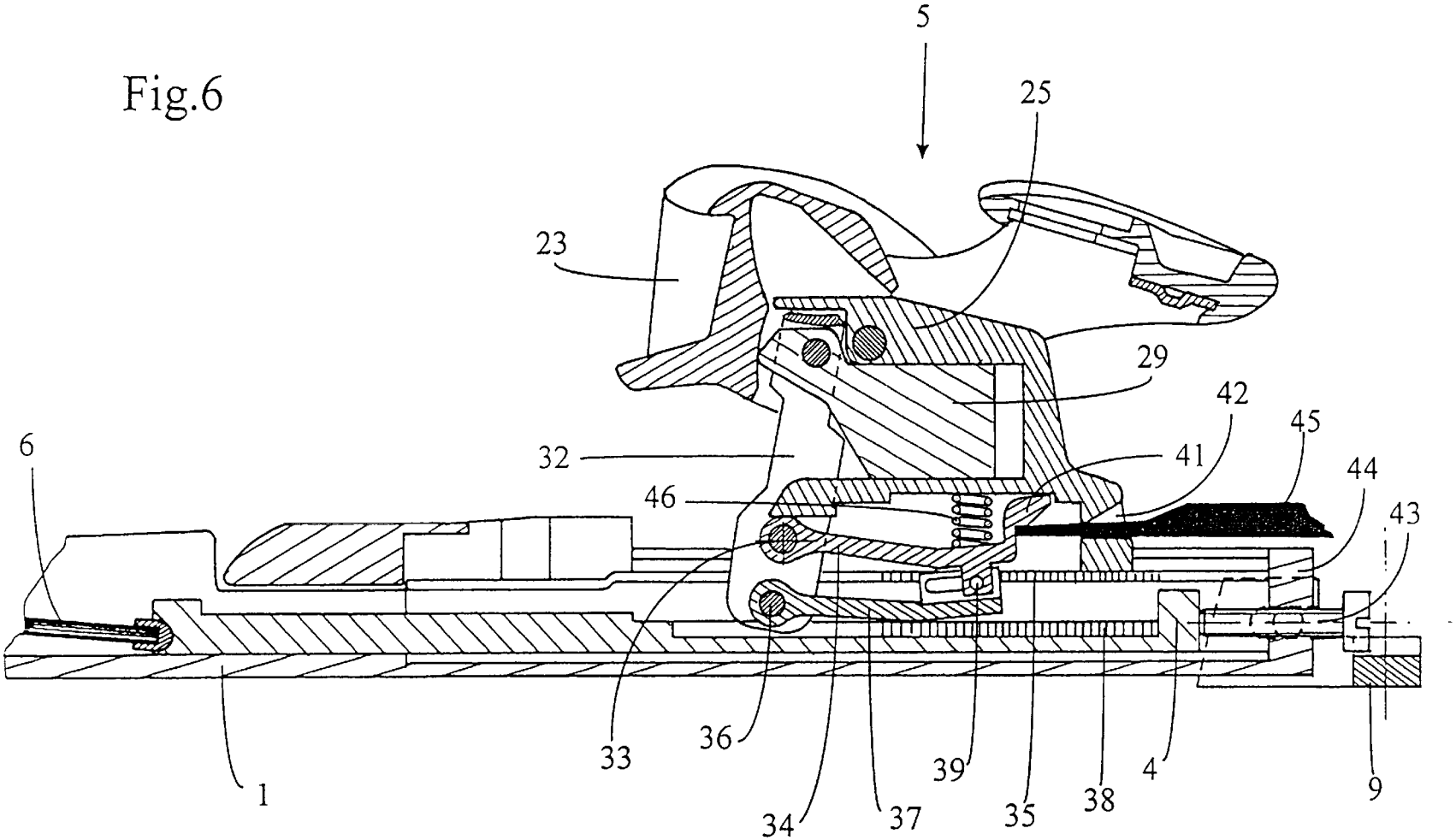
FIG. 6 is a sectioned view similar to FIG. 1, showing the heel piece in a position for adjusting to suit the boot size.

The binding also comprises a screw stop 43 mounted on by a vertical rear wall 44 of the support 1. This screw stop is used when adjusting the length of the binding, that is to say when adapting the binding to suit theboot size. This adjustment is depicted in FIG. 6. With the heel piece 5 open and the blade 6 therefore deformed in buckling, the screw 43 is screwed in until it comes into abutment against the slider 4. Using a tool 45, the arm 34 is raised via its elbowed end 41 so as to disengage the teeth of this arm from the teeth 35 of the support 1. As the arms 34 and 37 are connected by the articulation 39, the teeth of the arm 37 are also disengaged from the teeth 38 of the slider 4. The compression of the blade 6 is maintained by the screw stop 43. The heel piece 5 can therefore be moved along the support 1. A spring 46 causes the teeth of the arms 34 and 37 to re-engage in the respective sets of teeth 35 and 38. Once the re-engagement has occurred, the screw 43 can then be unscrewed to return it to the position depicted in FIG. 5, that is to say a position in which the blade 6 can return to a straight unbuckled position as depicted in FIG. 1.

FIG. 1 depicts the binding without a boot. When a boot is secured in the binding, the arms 14 and 15 of the front stop 3 will be parted slightly by the thrust of the sole of the boot. The tie rod 13 will therefore be in tension so that the lever 17 is pressed firmly against the end of the slider 2. As the slider 4 is rigidly held, the blade 6 is subjected to a certain amount of axial compression, this compression not, however, being enough to cause this blade to buckle.

When a great deal of stress is exerted, either in terms of torsion on one of the arms 14 or 15 of the stop 3, or upward on the jaw 23 of the heel piece 5, the axial compression of the blade 6 increases until this compression becomes great enough (the Euler force) to cause the blade to buckle, this buckling allowing the slides 2 and 4 to move closer together and therefore allowing the parting of the stressed arm 14 or 15 or the lifting of the jaw 23, allowing the boot to come free of the binding. During buckling, the resistance offered by the blade drops sharply, encouraging the boot to come free.

The binding setting is adjusted by altering the length of that part of the blade 6 which is able to buckle. This adjustment is achieved by moving the part 22 (FIG. 4) using the screw 20. It can be seen in this figure that the length of the blade 6 liable to buckle is between the moving part 22 and the slider 4. The more this length is shortened, the tighter the binding will be. The length of that part of the blade which is between the part 22 and the slider 2 is of course always markedly shorter than the length of the part lying between the part 22 and the slider 4.

The screw 20 could of course be mounted in the slider 4, but for space and convenience reasons it has been mounted in the slider 2.

The blade 6 is preferably made of composite material, for example glass-fiber reinforced plastic or carbon-fiber reinforced plastic.

In place of a single blade, it would be possible to use several blades, particularly stacked blades or blades placed side by side.

Although illustrative embodiments of the invention have been shown and described, a wide range of modification, change and substitution is contemplated in the foregoing disclosure and in some instances, some features of the present invention may be employed without a corresponding use of the other features. Accordingly, it is appropriate that the appended claims be construed broadly and in a manner consistent with the scope of the invention.

What is claimed is:

1. A ski binding intended for disengageably attaching a boot to a ski, comprising a stop (3), and a heel piece (5) both the stop and the heel piece being held elastically in a determined longitudinal position corresponding to the position of the boot attached to the ski, exclusively by an elastic blade (6) connected therebetween, wherein said blade (6) operates in buckling mode to control the engagement and safety release of the boot to the binding, thus eliminating the need for separate safety-release springs in the stop and the heel piece.

2. The ski binding as claimed in claim 1, wherein said blade (6) operates in buckling mode between two parts (2, 4) that can move in longitudinal translation and which are kinematically connected to the stop (3) and to the heel piece (5), respectively.

3. The ski binding as claimed in claim 1, wherein the stop (3) and the heel piece (5) ate mounted on a longitudinal support (1) in the form of a slide, and wherein two sliders (2, 4) are mounted in the longitudinal support (1) and connected respectively with the stop and with the heel piece so as to be displaced with the stop or the heel piece, said blade (6) being fixed to and between these sliders.

4. The ski binding as claimed in claim 3, wherein the heel piece (5) comprises a body (25) attached to the longitudinal support and a sole-gripping jaw (23) articulated to said body about a transverse axle (26) and having a ramp (27) cooperating with a retaining element, wherein the retaining element comprises a lever (32) articulated at an intermediate point (33) on said body (25) about a transverse axle and the lower end (36) of which is connected to the slider (4) associated with the heel piece so as to stress the blade (6).

5. The ski binding as claimed in claim 3, in which the stop (3) comprises a jaw formed of two pivoting arms (14, 15) held by a common tie bolt (13), wherein the tie bolt (13) is connected to a lever (17) articulated to said longitudinal support (1) and pressing against the end (19) of the slider (2) which is the opposite end to the blade (6), so that tension exerted on the tie bolt by said arms (14, 15) has the effect of axially compressing said blade (6).

6. A ski binding as claimed in one of claims 3, 4 and 5, which comprises a means of adjusting the release setting, this means comprises a part (22) surrounding said blade and mounted like a nut on a longitudinal adjusting screw (20) mounted and retained axially in one of said moving parts (2, 4).

7. The ski binding as claimed in claim 4, in. which the position of the body (25) of the heel piece (5) is adjustable on a longitudinal support, wherein said longitudinal support (1) has serrations (35) in which the teeth of a first arm (34), articulated about the articulation axle (33) of the lever (32) of the heel piece engage, and wherein the slider (4) associated with the heel piece also has serrations (38) situated beneath the serrations of the longitudinal support and in which teeth of a second arm (37) providing the connection between said lever (32) and the slider (4) engage, these two arms being secured together in such a way that disengagement of the first arm from its serrations by raising this arm also has the effect of disengaging the second arm from its serrations.

8. The ski binding as claimed in claim 7, which comprises an axial screw stop (43) allowing the slider (4) associated with the heel piece to be held in a position in which the blade (6) is deformed in buckling mode when the second arm (37) is detached from the slider (4).

9. A ski binding as claimed in one of claims 3, 4, 5, 7 and 8, wherein said longitudinal support (1) is attached to the ski by its ends by means of two supports (7, 9), is articulated to tile front support about a transverse axle (8), and is mounted to move longitudinally with respect to the the rear support (9).

* * * * *